United States Patent [19]

Marchello

[11] Patent Number: 4,551,861

[45] Date of Patent: Nov. 12, 1985

[54] WRESTLING HELMET EAR PADS

[75] Inventor: John L. Marchello, Traverse City, Mich.

[73] Assignee: Danmar Products, Inc., Ann Arbor, Mich.

[21] Appl. No.: 570,887

[22] Filed: Jan. 16, 1984

[51] Int. Cl.[4] ..... A42B 3/00

[52] U.S. Cl. ..... 2/425; 2/209

[58] Field of Search ..... 2/421, 425, 209

[56] References Cited

U.S. PATENT DOCUMENTS

| | | | |
|---|---|---|---|
| 2,277,994 | 3/1942 | Roberts | 2/425 X |
| 2,886,818 | 5/1959 | Roberts | 2/425 X |
| 2,898,596 | 8/1959 | Keen | 2/425 X |
| 3,311,921 | 4/1967 | Helm | 2/425 X |
| 3,327,316 | 6/1967 | Pukish | 2/425 X |
| 3,594,815 | 7/1971 | Reese | 2/421 |
| 3,596,288 | 8/1971 | Marchello | 2/421 |
| 3,628,191 | 12/1971 | Douglas | 2/425 X |

*Primary Examiner*—Louis K. Rimrodt

*Attorney, Agent, or Firm*—Cullen, Sloman, Cantor, Grauer, Scott and Rutherford

[57] ABSTRACT

An ear pad for fastening within the ear protective guard of a helmet is formed of a thick, resilient, rubber-like sheet material that is molded with a central ear receiving pocket surrounded by bulged, cushion-forming strips which engage the wearer's head around the ear. The strips bulge away from, that is, they open towards, the helmet guard and the edges of the strips engage the helmet guard surface to thereby form resilient, compression chambers that absorb and redistribute impact shocks. A portion of the sheet surface at the pocket and adjacent the guard wall is depressed away from the guard wall to form a shallow, relatively wide, hollow chamber between the pocket and the guard wall to provide a compression chamber overlying the ear.

6 Claims, 11 Drawing Figures

WRESTLING HELMET EAR PADS

BACKGROUND OF INVENTION

This invention relates to an improved ear pad which is particularly useful in helmets of the type disclosed in my prior U.S. Pat. No. 3,596,288 for a wrestling helmet issued Aug. 3, 1971. Such patent discloses a wrestling helmet comprising a pair of ear covering, cup-like guards secured to the wearer's head by means of straps that extend over the top of the head, around the rear of the head, and under the chin. The guards, which cover and protect the wearer's ears, contain a pad which is necessary for the wearer's comfort and protection.

The ear pad generally comprises a three layer lamination of an inner plastic sheet, a thick, foam plastic layer and an outer plastic sheet layer which are fastened together and shaped in a generally triangular form to provide an ear receiving pocket substantially surrounded by a bulged cushion strip which extends around the outside of the ear and against the wearer's head. Although that construction has been satisfactory in actual wrestling helmets built in accordance with the above-identified patent, the present application relates to an ear pad molded out of a single, flat sheet-like material which provides protection and comfort and is relatively inexpensive to produce.

SUMMARY OF INVENTION

The invention herein contemplates forming an ear pad for insertion within an ear protective guard of a helmet with the pad being molded out of a single sheet of resilient, rubber-like material to provide a central ear receiving pocket with surrounding bulged, cushion-forming strips for engaging the wearer's head around the ear. The bulged strips are hollow, roughly U-shaped channels whose free edges engage against the surface of the guard so as to form air containing compression chambers. These chambers may be further subdivided by integral, resilient walls extending transversely of the channels.

An additional, shallow, flat compression chamber, which generally overlays the ear, if formed by depressing a substantial portion of the pocket forming central portion of the sheet in a direction away from the wall, that is, towards the wearer's head. This forms a space between the surface of the pad and the shell wall against which it engages.

The molded form of ear pad can substantially reduce the expense of such ear pads while simultaneously increasing the comfort and protection of the pad, particularly due to the cushion-forming compression chambers which absorb and redistribute impact shocks.

One object of the invention is to provide a better fit of the helmet to the head which is obtained by being able to make the pocket deeper and the pad to conform more easily to the contoured area of the head around the ear due to the molding of the single sheet and by the use of the resilient material.

Another object of the invention is to improve the gripping surface of the ear pad to reduce the relative slippage between the ear pad and the ear during violent physical activities, such as during wrestling. This is obtained by molding the one piece ear pad out of a soft, somewhat tacky, synthetic rubber which is characterized by having a relatively high frictional surface. This contrasts with prior ear pads which utilized plastic sheets and consequently, had a lower coefficient of friction.

Since the prior ear pads utilized three layers, separate operations were required to cut and shape each of the layers and to seal them together. With the present invention, the manufacturing is considerably simplified since the molded part is made of a single material of a single layer. Likewise, the molded structure is easier to flex and assemble within the helmet ear guard.

These and other objects and advantages will become apparent upon reading the following specification, of which the attached drawings form a part.

DETAILED DESCRIPTION

The drawings illustrate a wrestling helmet 10 which is formed of two identical, but mirror image, roughly inverted triangular-shaped guards 11. Each guard is formed with an outwardly bowed ear cup 12 surrounded by marginal flanges 13.

Figure 2:
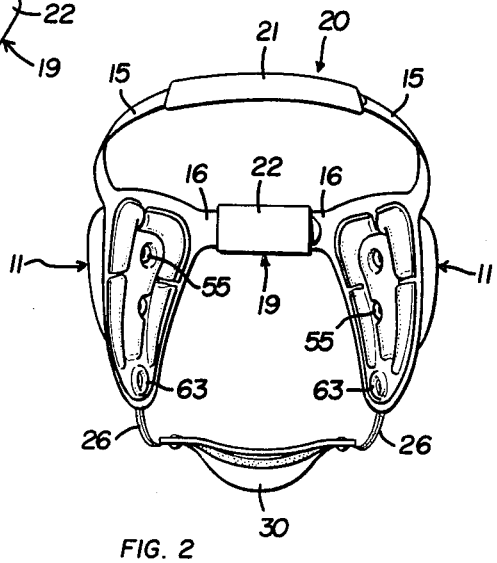
FIG. 2 is a front elevational view of the helmet, per se.

The guards are each made of a thin, relatively stiff, but somewhat flexible sheet plastic, such as of a suitable polyvinyl or polyethylene material which resiliently flexes, but which remains relatively stiff and self-sustaining in the absence of pressure. Integral with the upper corners of the guards are upper strap members 15 and rear strap members 16. Rows of holes 17 are formed in the straps 15 to receive snap fastener halves 18 attached to the straps 16. Thus, the corresponding pairs of upper and rear straps may be fastened together by snap fastening the snap fastener halves into pre-selected holes for size adjustment. The connected straps provide an adjustable rear strap 19 and an adjustable upper strap 20 for the helmet. To protect against accidental disengagement of the snap fastener halves 18 from the respective holes 17, thin, flat, tubular sleeves 21 and 22, formed of suitable plastic material, may be closely and slidably fitted over the upper and rear straps. These cover and protect the snap fastener halves as shown in FIG. 2.

The rear strap passes around the rear of the head at the base of the skull and the upper strap goes over the upper portion of the head, rearwardly of the forehead. Thus, the generally triangular-shaped ear cups overlie the wearer's ears.

The lower portion of the ear cups 12 are depressed to form depressed sockets 24 whose bases are co-planar with the guards marginal flanges 13. A hole 25 is formed in the base of each socket.

The lower corners of the guards are connected together by a chin strap 27 which is provided with a buckle or the like fastener 27 for connection to the hole 25 in the socket 24. The strap is split in the middle to form upper and lower strap portions 28 and 29 which are fastened to a chin cup 30.

Preferably the chin strap and chin cup are made of a plastic material which is similar to or identical to that used in making the guards.

In order to fasten the chin strap halves 28 and 29 to the cup, they may be passed through loops 31 formed integral at the opposite ends of the cup.

The foregoing construction is the same as that disclosed in my prior U.S. Pat. No. 3,596,288 of Aug. 3, 1971. The improvement of this present application relates to the ear pad fitted within the guard cups.

Thus, each cup contains an ear pad 35 which overlies the wearer's ear and the head portion surrounding the ear to protect against impact and to distribute impact loads.

Each pad is formed of a sheet molded from a rubber-like material which is resilient, substantially air impervious, and has the necessary characteristics to resist the forces, perspiration and the like to which a helmet is subjected. Preferably the sheet is made of a relatively soft, somewhat tacky surface material, that is, a rubber-like material which is characterized by having a substantial amount of friction on its surface so the surface is not smooth. While a number of different synthetic rubbers are suitable for selection for this purpose, one particular material utilized and found to be suitable is a synthetic rubber identified as Kraton D commercially sold by Shell Chemical Company. This thermoplastic rubber or elastomeric material has been found to have the tensile strength, resiliency or elasticity, hardness, and resistance to atmosphere and perspiration which makes it useful for the intended purpose as described herein.

The material is believed to be made of a mixture of styrene-butadiene-styrene and styrene-isoprene-styrene.

In manufacturing the pads, the material is molded in a suitable cavity type mold into the shape which will be described below.

The central portion of the ear pad is shaped to form an ear receiving pocket 37. This is surrounded by a continuous margin 38, in turn integral with surrounding bulged, cushion-like strips which form a pair of upper strips 39 and a pair of lower strips 40. Border or margin portions 41 and 42 are formed on the outer edges of the respective strips.

The interiors of the upper strips 39 are hollow to form chambers which are subdivided into smaller chambers or vaults 43 by means of integral walls 44. Likewise the hollow interiors of the lower strips 40 form chambers which may be either subdivided with walls (not shown) or left open.

The opposite ends of each of the strips are closed off with the strips being separated by notches or spaces 46 so that they may be flexed into position within the cup-like portions of the guards.

Figure 8:
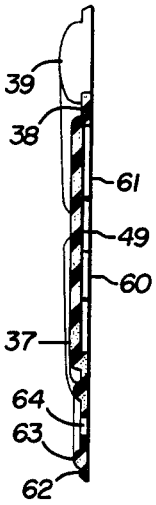
FIG. 8 is a cross-sectional view of the pad taken in the direction of arrows 8—8 of FIG. 7.
Figure 9:
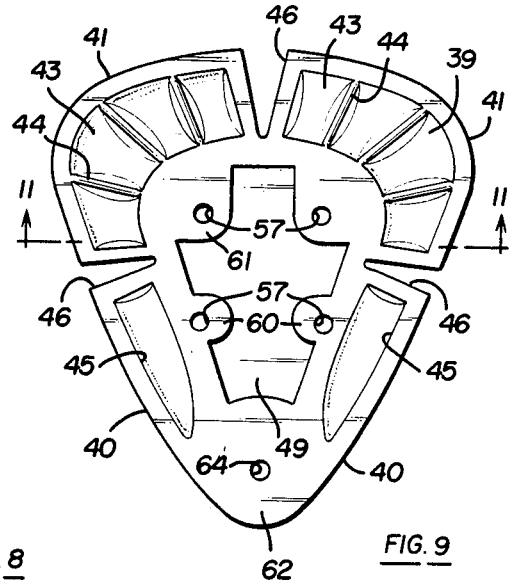
FIG. 9 is a view of the rear face of the pad.
Figure 10:
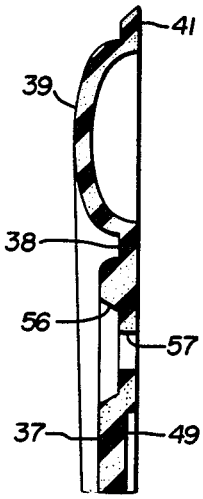
FIG. 10 is an enlarged cross-sectional, fragmentary view of the pad taken in the direction of arrows 10—10 of FIG. 7.
Figure 11:
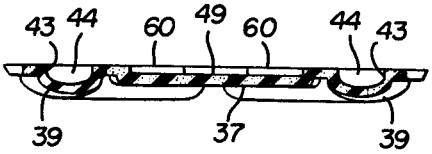
FIG. 11 is a cross-sectional view taken in the direction of arrows 11—11 of FIG. 9.

The surface of the pocket forming portion of the pad which is placed adjacent the guard surface is depressed to form a shallow, large, hollow chamber 49 (see FIGS. 8 and 9). This hollow space or chamber generally overlaps the ear of the wearer.

Each pad is positioned within a cup and is flexed to conform to the shape of the cup. The pads are fastened in place within the cup by means of rivets 55 which are preferably ring or hollow shaped to serve as vents.

These rivets are positioned within rivet sockets 56 having central holes 57 in the pads and corresponding holes 58 located within depressed socket 59 formed in the guards. The pad has molded portions 60 and 61 surrounding each of the rivet holes 57 within the shallow, depressed chamber portion 49 (see FIG. 9).

Figure 3:
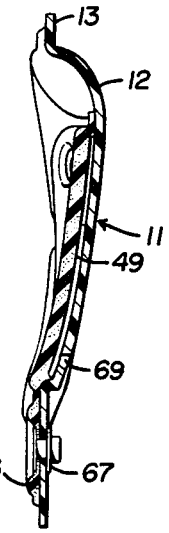
FIG. 3 is an enlarged, elevational view of one of the protective ear guards with its integral straps, and showing the ear pad.
Figure 4:
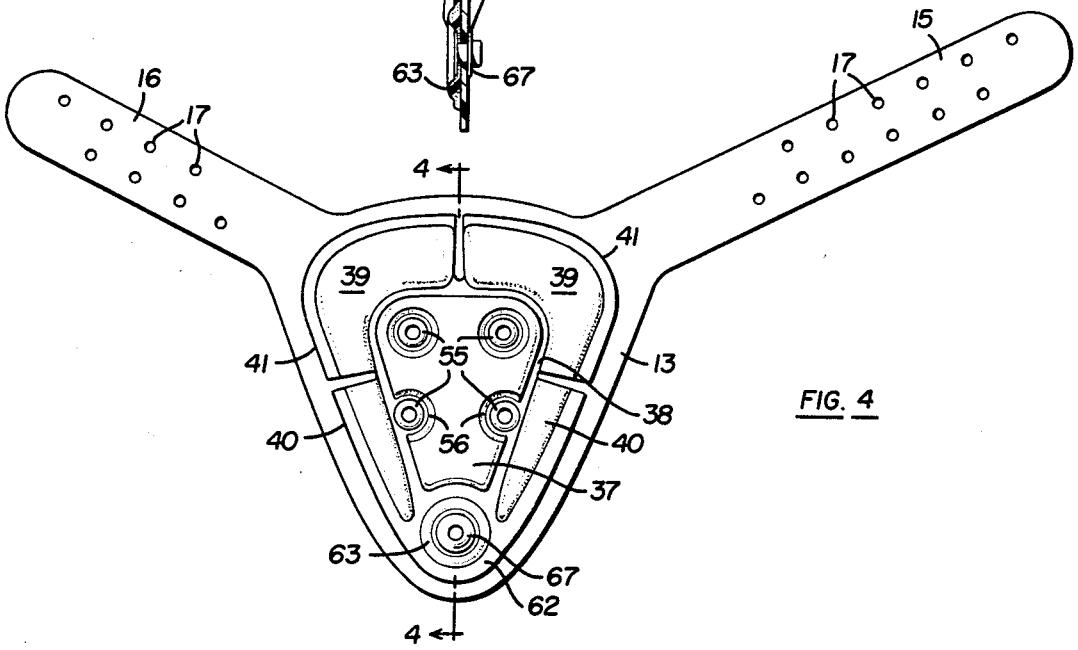
FIG. 4 is a cross-sectional view taken in the direction of arrows 4—4 of FIG. 3.
Figure 5:
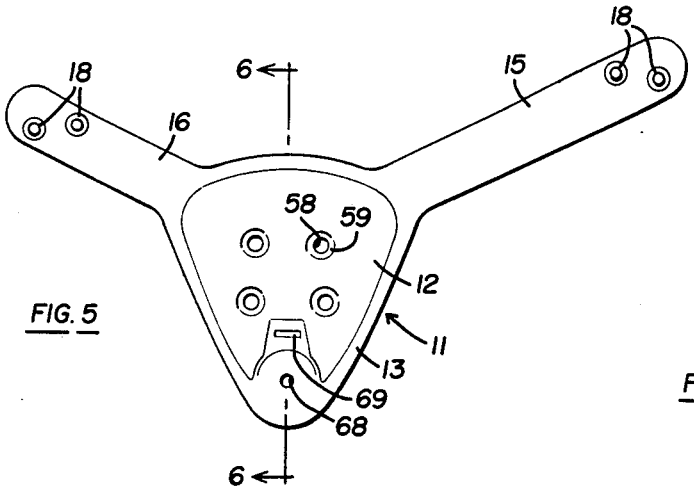
FIG. 5 is an elevational view, to a smaller scale, showing the ear guard with the pad removed.
Figure 6:
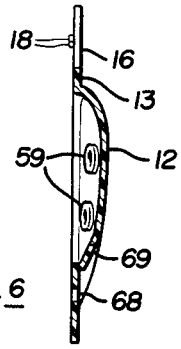
FIG. 6 is a cross-sectional view of the ear guard taken in the direction of arrows 6—6 of FIG. 5.
Figure 7:
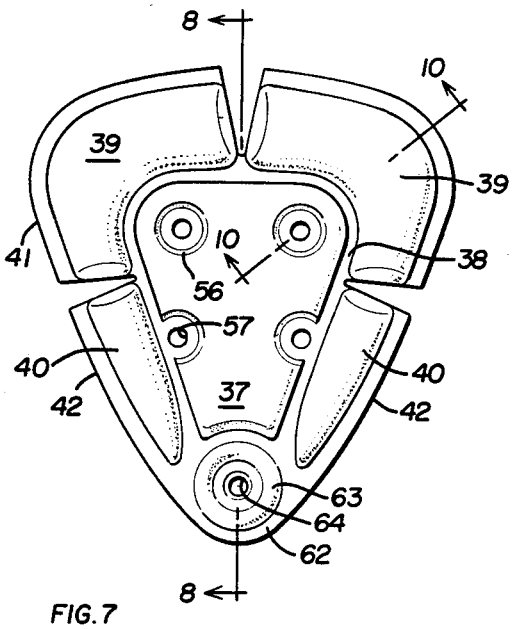
FIG. 7 is an enlarged view of the pad.

The lower portion of the pad is preferably provided with a flattened socket portion 62 having a molded annular ring 63 with a hole 64 for receiving the mechanical fastener, such as a snap fastener which will be used to connect the chin strap buckle 27 to the guard. This fastener may be in the form of a snap 67 (see FIG. 3). This snap also passes through a corresponding hole 68 located at the bottom of the guard (see FIG. 5).

Figure 1:
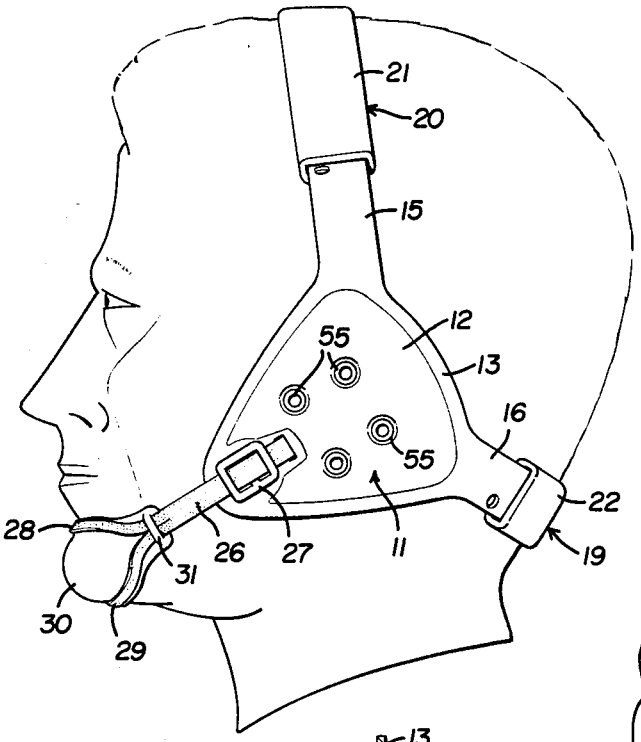
FIG. 1 is a side elevational view showing a wrestling helmet positioned upon a wearer's head.

In operation, the wearer positions the helmet upon his head, as illustrated in FIG. 1, and secures the chin strap in place. The free ends of the chin strap may be fitted into slots 69 formed near the lower ends of the cups (see FIG. 5). Thus, the helmet closely conforms to the wearer's head and because it is made of a thin, plastic sheet material, it is substantially impossible to dislodge or twist by grasping it during strenuous activities, such as during wrestling. Meanwhile, the pad covers the wearer's ear and the bulged cushion strips surround the ear, contacting the wearer's head. In the event of impact or other applied forces, the loads are absorbed and redistributed by means of the hollow vaults or hollow interior chambers forming compression chambers that are filled with air and compress. Because the marginal edges of the strips engage against the interior walls of the cups, they are sealed, at least during the times that loads are applied and thereby, act as inflated protective cushions.

The shallow hallow portion 49 which overlies the ear likewise has an air compression effect in protecting the ear.

Having fully described an operative embodiment of this invention, I now claim:

1. An ear pad for a helmet having an ear protective cup-like guard sized and shaped to overlay the wearer's ear and head portion around the ear, with the ear pad fastened within the cup and having a central, depressed, ear receiving pocket, with cushion-forming bulged strips around at least part of the periphery of the pocket for engaging areas of the wearer's head around the ear, the improvement comprising:

said ear pad being formed of a relatively thick, molded sheet of a resilient, rubber-like material, with the sheet having an inner surface adjacent the wearer's head and an outer surface adjacent the wall of the cup-like guard;

the center portion of the sheet forming a resilient ear receiving pocket, and the sheet portions at the periphery of the pocket being inwardly bulged to form peripheral strips of cavities that open towards said wall, with the peripheral edges of the strips shaped to directly engage against said wall, wherein the stips act as resilient air chambers when said pad is assembled to the cup-like guard;

whereby the ear pad absorbs and redistributes impact shocks applied to the helmet ear guard by resilient deformation of the rubber-like material and by compression and distortion of the air filled strips of cavities.

2. An ear pad as defined in claim 1, and wherein the bulged strips are generally U-shaped in cross-section, with the free edges of the legs being widened to form continuous borders that engage and seal against the guard wall.

3. An ear pad as defined in claim 2, and with transverse, integral, thin, resilient walls formed at spaced apart locations within at last one strip and extending to the plane of said borders so as to subdivide the strip air chamber of the assembled helmet into a number of separated smaller, air filled, vaults which provide a number of independent, resiliently compressible cushions.

4. An ear pad as defined in claim 2, and wherein a considerable portion of the outer surface of the portion of the sheet forming the ear receiving pocket is recessed away from the guard wall and in a direction towards the sheet inner surface, to thereby form a substantially flat, shallow, hollow chamber between the pocket and the guard wall overlaying the wearer's ear, for absorbing and redistributing impacts directed to the ear.

5. An ear pad for a wrestling-type helmet guard shaped to cover the wearer's ear and surrounding head portions, comprising:

a thick, rubber-like, molded sheet having an outer surface adjacent the surface of the guard, and an inner surface adjacent the ear and head;

a center portion of the sheet being formed as an ear receiving pocket;

the sheet portions around the pocket being molded into strips of inwardly bulged cavities that open outwardly with the strip edges pressing against the guard surface to form elongated, hollow, resilient compression chambers contacting the areas of the wearer's head around the ear;

a number of thin, resilient walls, integral with, and extending transversely across the strip cavities, and having their free edges engaging the guard surface to form separated, independent compression vaults;

and a portion of the outer surface of the portion of the sheet defining the pocket being recessed towards the sheet inner surface so that such portion is normally spaced a short distance from the guard wall, while adjacent portions of the sheet engage the guard wall to form a shallow, wide, resilient compression portion directly over the ear.

6. An ear pad as defined in claim 5, and said strips being separated one from another at their adjacent ends so that they may flex independently of each other.

* * * * *